US005676350A

United States Patent [19]

Galli et al.

[11] Patent Number: 5,676,350

[45] Date of Patent: Oct. 14, 1997

[54] PORTABLE BARRIER SYSTEM WITH PORTABLE POST MOUNTING DEVICE

[76] Inventors: George Galli, 163 Locust Ave., Springfield, Pa. 19064; Leo Parrillo, 4920 Old Frankstown Rd., Monroeville, Pa. 15146

[21] Appl. No.: 349,967

[22] Filed: Dec. 6, 1994

[51] Int. Cl.[6] ..... E01F 15/00

[52] U.S. Cl. ..... 256/13.1; 256/DIG. 6; 52/DIG. 12; 52/166; 404/6; 404/10

[58] Field of Search ..... 256/13.1, 19, DIG. 5, 256/DIG. 6, 47, 32; 404/6, 10; 52/DIG. 12, 125.2, 165, 166, 292, 296, 297, 298; 403/354, 349

[56] References Cited

U.S. PATENT DOCUMENTS

| | | | |
|---|---|---|---|
| 3,225,501 | 12/1965 | McCaron | 52/298 |
| 3,245,181 | 4/1966 | Stephenson | 52/122 |
| 3,423,781 | 1/1969 | Henjon | 403/349 X |
| 3,450,387 | 6/1969 | Thomas | 256/13.1 |
| 3,583,116 | 6/1971 | La Gue | 52/298 |
| 3,670,468 | 6/1972 | Cordell, Sr. | 52/298 |
| 3,869,218 | 3/1975 | Stoeber et al. | 403/349 X |
| 4,183,505 | 1/1980 | Maesri | 256/13.1 |
| 4,200,906 | 4/1980 | Santilli | 362/431 |
| 4,240,766 | 12/1980 | Smith et al. | 404/10 |
| 4,378,175 | 3/1983 | Hasselqvist et al. | 404/10 |
| 4,799,448 | 1/1989 | Junker | 116/63 |
| 4,815,713 | 3/1989 | Schmanski | 256/19 |
| 4,830,341 | 5/1989 | Arteau et al. | 256/DIG. 6 X |
| 4,992,005 | 2/1991 | Hilfiker | 52/125.2 X |
| 5,144,780 | 9/1992 | Geiling et al. | 52/298 |
| 5,163,967 | 11/1992 | Hoffman et al. | 52/299 |
| 5,180,143 | 1/1993 | Brower | 256/19 X |

FOREIGN PATENT DOCUMENTS

| | | | |
|---|---|---|---|
| 462818 | 12/1991 | European Pat. Off. | 404/6 |
| 571082 | 11/1993 | European Pat. Off. | 256/13.1 |
| 965404 | 10/1982 | U.S.S.R. | 256/13 |

*Primary Examiner*—Carl D. Friedman
*Assistant Examiner*—Yvonne Horton-Richardson
*Attorney, Agent, or Firm*—Frank J. Bonini, Jr.

[57] ABSTRACT

A portable barrier system including a portable post support device having a base member with a handle and an attachment mechanism for supporting a post, the post in turn supporting a barrier material.

20 Claims, 2 Drawing Sheets

PORTABLE BARRIER SYSTEM WITH PORTABLE POST MOUNTING DEVICE

BACKGROUND OF THE INVENTION

1. Field of the Invention

The field of the present invention relates to barrier systems, and in particular to portable barrier systems and post supports.

2. Description of the Prior Art

The building and construction industries rely heavily on barrier or baricade systems to prevent unwary pedestrians and unauthorized individuals from entering a job site, particularly where construction remains unfinished and presents a potentially hazardous condition. In many instances, construction tools and vehicles, the presence of work in progress, and other preparatory land modifications, such as, for example uneven terrain or ditches, are dangerous to those entering the work site. This holds especially true for trespassers who are likely to be unaware of the dangers which they may encounter.

Barriers may also be employed to enclose an area which has been contaminated with hazardous waste products, such as, for example, toxic chemicals emitted from a spill, or to protect an area undergoing a cleanup operation.

While warning signs and other alerting devices, such as for example flashing signal lights, have been employed to deter unauthorized individuals from entry onto the work site, there are those who will either pay no attention to the warning devices or simply overlook them. Moreover, laws of many governments and municipalities require contractors to safeguard the area in which they are working to prevent the public from entry into the area, and otherwise exposure to a potentially dangerous condition. The penalty for not providing adequate safeguards may have severe legal consequences from a liability standpoint. It is especially a concern today where increased instances of lawsuits are prevalent.

A barrier or barricade also protects work from damage by inhibiting access to the protected area. The use of a barrier system is beneficial, for example, around a location where concrete is poured and must set undisturbed before it can be used.

Therefore, extra precautions must be taken to prevent entry onto a job site by unauthorized individuals. It has been necessary to secure working areas and construction sites by enclosing the area within a barricade. Generally, in many instances a permanent barricade is impractical, and in some instances may be impossible to use, for example on account of any one or more of the following conditions: expense, time or geography. In some circumstances, the amount of time required to install a permanent fence structure around a work area would be considerably too great—for example, as in the case of a water main break which is to be repaired without delay. Likewise, when work is to be done on parking lots and sidewalks a permanent barricade may not be installed. In these situations, the typical solution has been to provide a temporary fence or barrier. Temporary fences must usually be installed in position around the work area to be protected in a short time, so that the work may proceed.

It is known to provide a concrete block which has a hole in it for receiving a stake. The stake in turn supports a plastic ribbon or fence (usually extending between successive stakes). However, such blocks are subject to breakage since the hole tends to weaken the structure of the block.

Furthermore, when these blocks are placed around the perimeter of a work area which is to be safeguarded, the edges of the blocks themselves can present a hazard to automobile tires and passersby. This hazard is further amplified by the tendency of the blocks to break, leaving sharp edges caused by the fragmentation of a portion of the block. Breakage of these blocks is often facilitated by the fact that the blocks are provided to be of a substantial weight and are difficult to transport. Another attempt at providing a post support has been to set a wheel or tire rim on the ground and place a stake in its center. However, transport of such devices is generally difficult.

SUMMARY OF THE INVENTION

The present invention provides a portable barrier system including a portable post support device having a base member with attachment means for supporting a post member, the post member in turn maintaining a barrier material. The base member is further provided with transport facilitating means, which can comprise a handle.

It is an object of the present invention to provide a portable barrier system which can be readily transported to and from the situs of use.

It is another object of the present invention to accomplish the above object by providing a post support device which can be readily transported to and from the situs of use.

It is a further object of the present invention to provide a post support in which the strength of the support is improved for greater stabilization of the post support against breakage.

An additional object of the present invention is to achieve any of the above objects wherein the post support maintains a temporary barrier material.

Another object of the present invention is to accomplish any of the above objects by providing a post support having improved safety characteristics.

BRIEF DESCRIPTION OF THE DRAWING FIGURES

DETAILED DESCRIPTION OF THE PREFERRED EMBODIMENTS

Figure 1:
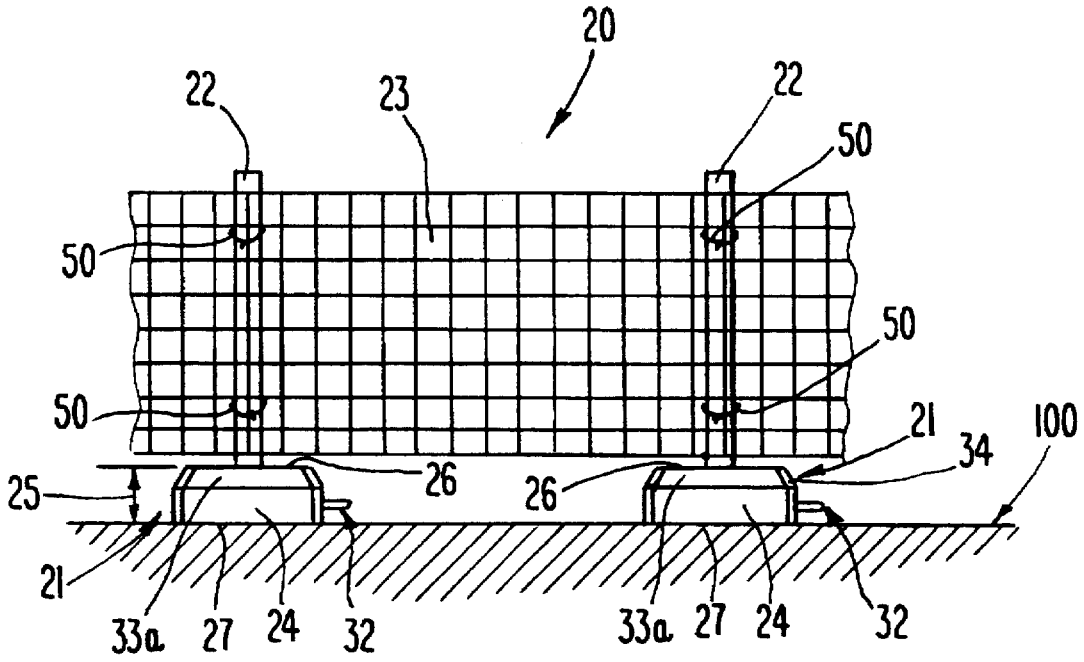
FIG. 1 is a front view of a section of a preferred embodiment of the portable barrier system according to the present invention shown with two post support devices and barrier material.

Referring to FIG. 1, a preferred embodiment of the present portable barrier system 20 with portable post support devices 21, is shown. The barrier system 20 is shown with the post members 22 supported by the post support devices 21. Barrier material 23 is maintained by the post members 22. The barrier material 23 can comprise any suitable material, such as for example, wire, burlap, and the like. Preferably, the barrier material 23 comprises a flexible material, such as a plastic or elastomeric material which can withstand the elements, and can be reused. Such barrier material is generally commercially available. It is understood that the barrier material 23 can be provided to be of any suitable length or dimension for variable sized construction of the barrier system 20.

The post-support device 21 is provided comprising a base member 24 having a height or thickness, generally represented by the arrows corresponding to numeral 25. The base member 24 is comprised of a dense material which will contribute mass to the post support device 21, such as for example, a concrete composition, or a high density plastic material. The base member 24 is shown having a top surface 26 and a bottom surface 27. In FIG. 1, the bottom surface 27 is shown resting on a supporting surface 100. The supporting surface 100, generally represents any location on which the post support device 21 is to be placed. The bottom surface 27, while not shown in detail, may be provided with feet, bosses, channels or the like to permit passage of water or air to freely travel underneath the base member 24, if desired. Preferably the base member 24 is comprised of a solid material for maximum mass. For example, the post support device can be form molded by pouring the base member material into a mold which contains the internal elements that are to be disposed in the base member 24.

Figure 2:
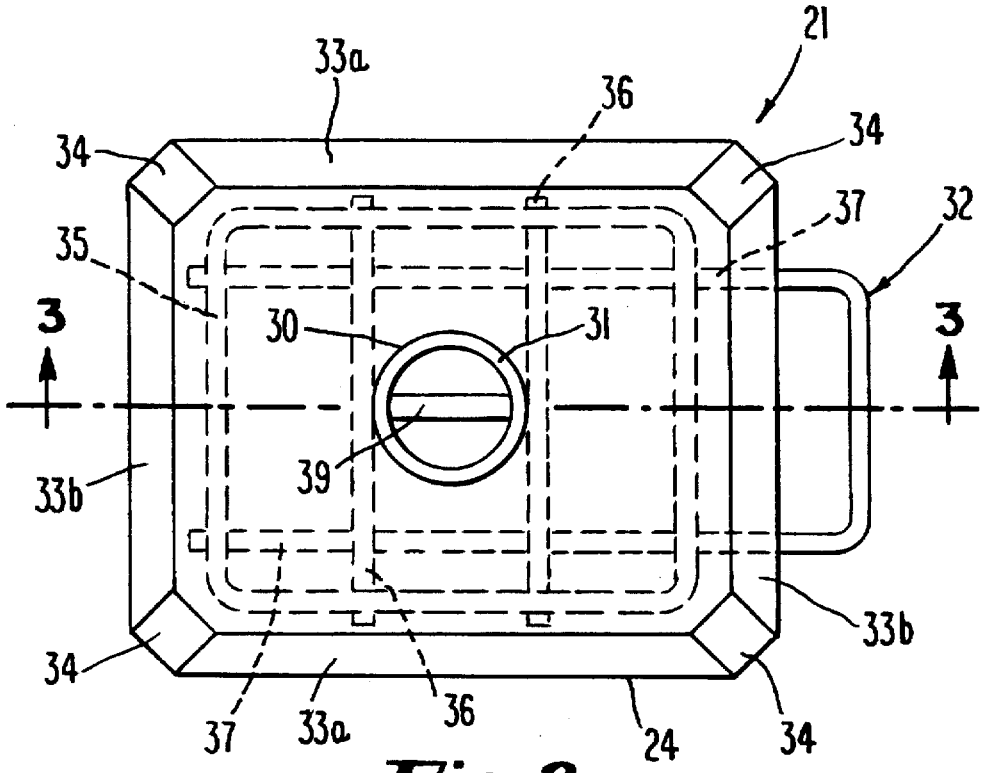
FIG. 2 is a top plan view of a preferred embodiment of the present post support device, showing the reinforcing supports in dotted lines.

Post-receiving means is also provided, and preferably comprises a bore 30 which is disposed within the base member 24, and extends from the top surface 26 into the center of the base member 24 (see FIG. 2). The bore 30 preferably extends entirely through the base member 24, and can also extend through the bottom 27 of the base member 24. The post-receiving means is shown further comprising a sleeve 31, which is fixedly disposed within the bore 30 of the base member 24. The sleeve 31 preferably comprises a tubular member which can comprise a material of suitable strength, such as for example steel or other metal, for receiving a post member 22 therein (see FIG. 1).

The post support device 21 is provided with transport facilitating means for facilitating the moving and carrying of the device 21. The transport facilitating means is shown comprising a handle 32, which is attached to the base member 24. The handle 32 enables the portable post support device 21 to be readily moved to and from different job sites or locations, or among different spots at a single location or job site. The handle 32 is preferably provided at a location of the base member 24 which renders the handle 32 in a condition which is least likely to be encountered by vehicular and/or pedestrian traffic when the support device 21 is employed with barrier system 20. This is best seen in FIG. 1, where the handle 32 is located on an end of the base member 24 and lies below the barrier material 23.

The upper edges of the base member 24 are preferably provided in a configuration which renders them blunt. The edges 33*a*, 33*b* are shown in a preferred chamfered configuration, to reduce the sharpness of otherwise right angled edges. The chamfered edges 33 (*a*)and (*b*) provide resulting corners in which the interior angles are greater than 90 degrees. The corner faces 34 of the base member 24 also contribute to further reduce edge sharpness.

While the chamfered edge configuration is shown (FIGS. 1–4), it is understood that the base edges may be provided having an arcuate or radial configuration. FIG. 5 shows an alternate post support device embodiment 121 having a single rounded edge configuration. A handle 132, similar to the handle 32 described above, is provided. Although a sleeve member, and support members are not shown in FIG. 5, it is understood that they can be provided as described above with the support device 121.

Figure 3:
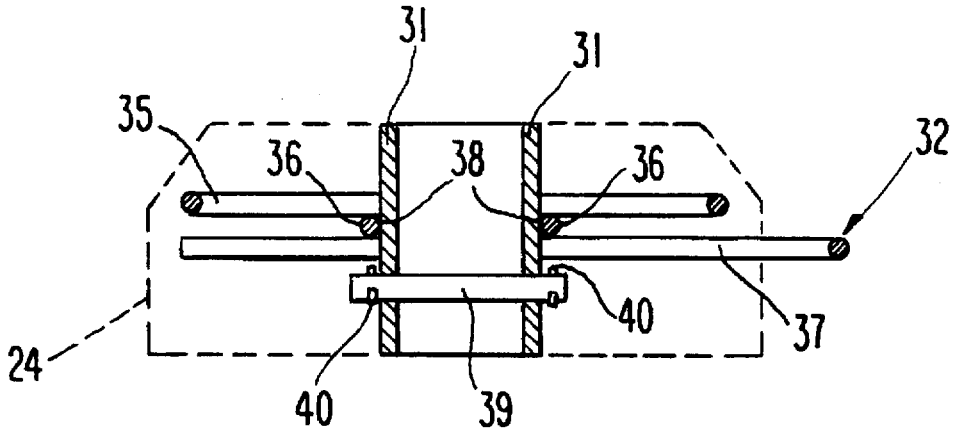
FIG. 3 is a sectional view of the embodiment shown in FIG. 2 taken laterally through the post support along the line 3—3 of FIG. 2, showing the internal elements of the device.

Reinforcing or support means are disposed within the base member 24 for providing strength to the post support device 21 to aid in absorbing a force load transmitted to the device 21 through handling, installation and transportation of the device 21. The reinforcing means comprises at least one supporting structural member, and preferably comprises more than one structural member for maximum support. FIG. 2 shows a preferred configuration of the support means in dotted-line representation, comprising a perimetric support 35, a pair of lateral supports 36, and adjacent supports or handle legs 37. Preferably, the supports 35, 36, 37, shown as rods in FIGS. 2 and 3, are comprised of a durable material such as steel, other metal, plastic, or any suitable hard material. The lateral supports 36 are shown disposed on opposite sides of the sleeve 31 (FIGS. 2 and 3), and are connected to the sleeve 31 for example by the welds 38 shown in FIG. 3, or by other suitable securing means. The perimetric support 35 is disposed within the perimeter of the base member 24, and may be provided in tangential relation to any one or more additional support members, such as, for example, any of those 36 and 37. For example, as best seen in FIGS. 2 and 3, the perimetric support 35 is preferably connected to the lateral supports 36, which in turn are preferably connected to the handle legs 37 which themselves also comprise supporting members, as well as means for retaining the handle 32.

Attachment means are provided for installing the post member 22 to the post support device 21. The post-receiving means comprising the bore 30 is shown provided with attachment means comprising a bar member 39 (see FIGS. 2–4) which diametrically traverses the sleeve 31. The bar member 39 preferably comprises a durable material, such as for example metal or plastic. The bar member 39 may be secured to the sleeve 31 by any suitable means, such as welding, gluing, or the like. In the embodiment of FIG. 3, the bar member 39 is shown extending through the sleeve 31 and secured with pins 40 at each end of the bar member 39 in order to prevent lateral displacement of the bar member 39. While pins 40 are shown to retain the bar member 39 in position, it is understood that the material comprising the base member 24, such as, for example, concrete or other suitable material, can also retain the bar member 39 in position.

Figure 4:
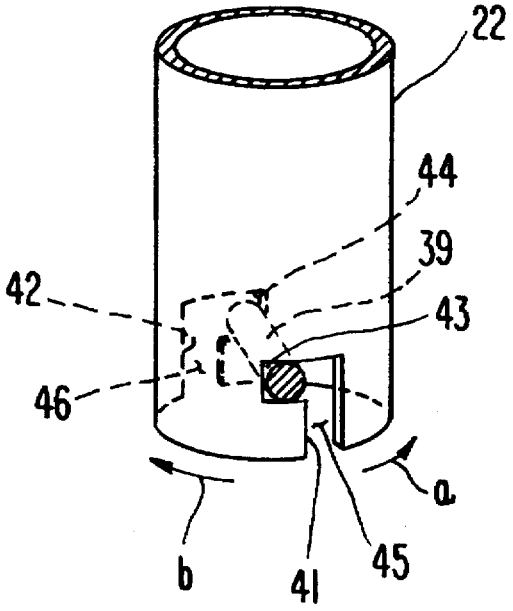
FIG. 4 is a front perspective view of an end of a post member and attachment means.
Figure 5:
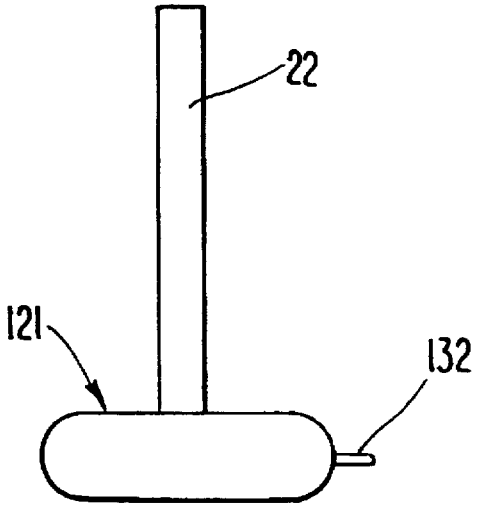
FIG. 5 is an alternate embodiment of the present post support device.

Referring to FIG. 4, the post member 22 is seen provided with complementary attachment means for securing the post member 22 within the sleeve 31 (FIGS. 2 and 3). The post member attachment means are shown comprising inverted L-shaped grooves 41 and 42 disposed on opposite sides of an end of the post member 22. The grooves 41 and 42 have horizontal components, respectively 43 and 44, and vertical components, respectively 45 and 46. The grooves 41 and 42 are provided in rotationally symmetrical relation to one another, such that the horizontal component 43, 44 of each respective groove 41, 42 is similarly directed (that is faces clockwise or counterclockwise). The post member 22 is installed within the sleeve 31 of the base member 24 by first lowering the post member 22 into the sleeve 31 so that the bar member 39 is aligned within the vertical component 45, 46 of each respective groove 41, 42. Next, the post member 22 is rotated in the direction of arrow "a" to engage the bar member 32 within the horizontal components 43, 44 of the respective grooves 41, 42. Likewise, the post member 22 is detached from the base member 24 by reversing the above procedure, rotating the post member 22 in the direction of arrow "b". In FIG. 4, the relation between the post member 22 and bar member 39 are shown for the installed condition of the post member 22 into the post support device 21.

The barrier system 20 can be installed by positioning a number of post support devices 21 around the perimeter of a given area to be barricaded, installing the post members 22, and attaching the barrier material to the post members 22 (see e.g. FIG. 1). Fastening means, such as the ties 50, can be employed to retain the barrier material to the post members 22. The ties 50 can comprise a suitable means, such as, for example, wire, plastic strips, and the like.

Furthermore, while not shown, it will be understood that a number of varied configurations can be achieved with the present barrier system. For example, a pen or enclosure can be constructed by using multiple post-support devices, such as those 21 described above, and further providing a gate means which can be either independent of or carried by a post member, such as those 22 described above.

It will be understood by one of ordinary skill in the art that further modifications within the scope of the present invention may be made in accordance with the description of the invention and the appended claims disclosed herein.

What is claimed is:

1. A portable barrier system comprising:

a) a post member;

b) a portable post support device, including a base member with transport means for facilitating transport of said post support device, and attachment means for attaching said post to said base member;

c) barricade material; and d) means for attaching said barricade material to said post;

e) wherein said means for attachment of said post to said base member include securing means by which said post can be selectively locked against a vertical displacement thereof and released to permit the removal of said post from said base member; and f) wherein rotation of said post member within said base member is prevented when the post member is selectively locked.

2. The portable barrier system of claim 1, wherein said base member is provided having reinforcing means for reinforcing said post support device.

3. The portable barrier system of claim 2, wherein said reinforcing means comprises at least one support member disposed within said base member.

4. The portable barrier system of claim 1, wherein said attachment means comprises a sleeve longitudinally disposed within said base member to define a socket therein for receipt of said post member.

5. The portable barrier system of claim 4, wherein said post member comprises a tubular member with one end having a pair of diametrically opposed inverted L-shaped grooves disposed therein at an end thereof, and wherein said sleeve comprises a tubular member having a bar member transversely disposed within said tubular member, whereby said bar member is received within said post member grooves when said post member is installed within said post support device.

6. A portable post support device comprising:

a) a base member;

b) a bore longitudinally disposed in said base member;

c) transport facilitating means for lifting and carrying said post support device;

d) wherein said bore includes a sleeve disposed therein provided with means for attachment of said post to said base member including securing means by which said post can be selectively locked against a vertical displacement thereof and released to permit the removal of said post from said base member; and e) wherein rotation of said post member within said base member is prevented when the post member is selectively locked.

7. The device of claim 6, further comprising a sleeve disposed within said bore and defining a socket for receiving a post member therein.

8. The device of claim 6, further comprising reinforcing means disposed within said base member.

9. The device of claim 7, further comprising reinforcing means disposed within said base member.

10. The device of claim 6, wherein said transport facilitating means comprises a handle fixedly connected to said base member.

11. The device of claim 9, wherein said transport facilitating means comprises a handle fixedly connected to said base member.

12. The device of claim 9, wherein said handle is partially disposed within said base member.

13. The device of claim 11, wherein said handle includes a pair of leg members and a connecting portion connecting said leg members, said leg members being at least partially disposed within said base member.

14. The device of claim 13, wherein said leg members comprise reinforcing means.

15. The device of claim 9, wherein said reinforcing means comprises at least one rod disposed within said base member.

16. The device of claim 9, wherein said reinforcing means comprises a pair of rods disposed within said base member, each said rod being connected to said sleeve at a diametrically opposite position relative to each other, wherein said rods each extend beyond said base member and are connected to one another by a connecting portion to form said transport facilitating means; and wherein said transport facilitating means comprises additional reinforcing means for absorbing a force transmitted to said sleeve from said post.

17. The device of claim 6, further comprising a post member having a pair of inverted L-shaped grooves disposed at an end thereof, each said groove having a vertical component and a horizontal component, and a transverse bar member disposed within said sleeve, said post member grooves and said bar member comprising mounting means for mounting said post to said base member.

18. A portable post support device comprising:

a) a base member;

b) a bore longitudinally disposed in said base member;

c) transport facilitating means for lifting and carrying said post support device;

d) a sleeve disposed within said bore, said sleeve defining a socket for receiving a post member therein and being provided with means for attachment of said post to said base member including securing means by which said post can be selectively locked against a vertical displacement thereof and released to permit the removal of said post from said base member;

e) reinforcing means disposed within said base member; and f) wherein said reinforcing means comprises a pair of rods disposed within said base member, each said rod being connected to said sleeve at a diametrically opposite position relative to each other, wherein said rods each extend beyond said base member and are connected to one another by a connecting portion to form said transport facilitating means; and wherein said transport facilitating means comprises additional reinforcing means for absorbing a force transmitted to said sleeve from said post.

19. A portable barrier system comprising:

a) a post member;

b) a portable post support device, including a base member with transport means for facilitating transport of said post support device, and attachment means for attaching said post to said base member;

c) barricade material; and d) means for attaching said barricade material to said post;

e) wherein said means for attachment of said post to said base member include securing means by which said post can be selectively locked against a vertical displacement thereof and released to permit the removal of said post from said base member, said securing means including a sleeve member disposed within said base;

f) wherein rotation of said post member within said base member is prevented when the post member is selectively locked; and g) support members disposed within the base;

h) a handle connected to and supported with said support members;

i) wherein said sleeve member is connected to said support members.

20. A portable post support device comprising:

a) a base member;

b) a bore longitudinally disposed in said base member;

c) transport facilitating means for lifting and carrying said post support device;

d) a sleeve disposed within said bore, said sleeve defining a socket for receiving a post member therein and being provided with means for attachment of said post to said base member including securing means by which said post can be selectively locked against a vertical displacement thereof and released to permit the removal of said post from said base member;

e) reinforcing means disposed within said base member; and f) wherein said reinforcing means comprises a pair of rods disposed within said base member, each said rod being connected to said sleeve and extending beyond said base member, wherein said rods and are connected to one another by a connecting portion to form said transport facilitating means.

* * * * *